US005497811A

United States Patent [19]

Pigna

[11] Patent Number: 5,497,811

[45] Date of Patent: Mar. 12, 1996

[54] DEVICE FOR BENDING THE ENDS OF METALLIC BINDING SPIRALS

[75] Inventor: Daniele P. Pigna, Bergamo, Italy

[73] Assignee: Rilecart S.R.L., Bergamo, Italy

[21] Appl. No.: 241,533

[22] Filed: May 12, 1994

[30] Foreign Application Priority Data

May 31, 1993 [IT] Italy ..... MI93A1128

[51] Int. Cl.[6] ..... B21F 45/16

[52] U.S. Cl. ..... 140/71 R; 412/39

[58] Field of Search ..... 140/71 R, 92.3, 140/92.7; 412/34, 38, 39

[56] References Cited

U.S. PATENT DOCUMENTS 2,065,505 12/1936 Bidwell ..... 140/92.7

2,730,142 1/1956 Berberich ..... 140/92.3

3,667,076 6/1972 Aglaghanian et al. ..... 412/39

*Primary Examiner*—Lowell A. Larson

*Attorney, Agent, or Firm*—Panitch Schwarze Jacobs & Nadel

[57] ABSTRACT

A device for bending the ends (17) which result from cutting to size a metallic binding spiral (9) includes a contrasting member (4) provided at the front with two pairs (12, 12') of flat lugs, mutually parallel and orthogonal to the axis of the spiral (9), suitable to securely retain the roots (16) of the two prongs (14) of the spiral (9) between which the cut has been performed, and a pushing member (7) provided at the front with a central tooth (13) radiused to the body of the pusher (7) and also orthogonal to the axis of the spiral (9), suitable to bend the ends (17) parallelly to the prongs (14) by interacting with said contrast (4). The contrast (4) and the pusher (7) move along substantially orthogonal axes under the action of double-acting pneumatic jacks.

7 Claims, 2 Drawing Sheets

1
2
3
4
5
6
7
8
9
10
11
12
12'
13
B
C

DEVICE FOR BENDING THE ENDS OF METALLIC BINDING SPIRALS

The present invention concerns devices for the production of metallic binding elements, and particularly a device suitable to bend the end of the element after it has been cut to size to carry out the binding operation.

It is known that said metallic binding elements are produced from a plastic-coated metallic wire which is bent in successive steps until it forms a series of curved prongs on which the sheets to be bound are inserted prior to closing said prongs to a ring shape by bringing their tips next to the respective roots. These binding elements are commonly called "spirals" though they do not have an exactly spiraliform shape, and this word will be used in the following for sake of simplicity.

The final binding operation takes place only after the spiral length has been cut to the size of the sheet height from the continuous spiral wound on a reel. This cut is performed on a length of wire, parallel to the spiral axis, which acts as a connection between two subsequent prongs, thus defining the spiral pitch. Therefore, it results that the spiral ends with a length of wire parallel to the axis thereof and having a metallic point which has been uncoated and jagged by the cutting tool.

It is apparent that this is a danger to those who handle the group of sheets thus bound, since said point may get into their hands or even worse it may hurt the face or the oral cavity of a child putting it into his mouth.

The object of the present invention is therefore to provide a device suitable to prevent said possibilities by bringing the spiral end parallel to the prongs, so that it does not project axially.

The apparent advantage of the device according to the present invention is that the metallic point is bent so that it does not project and therefore is no more a danger to those who handle the bound sheets.

Figures 1A, 1B, 1C:
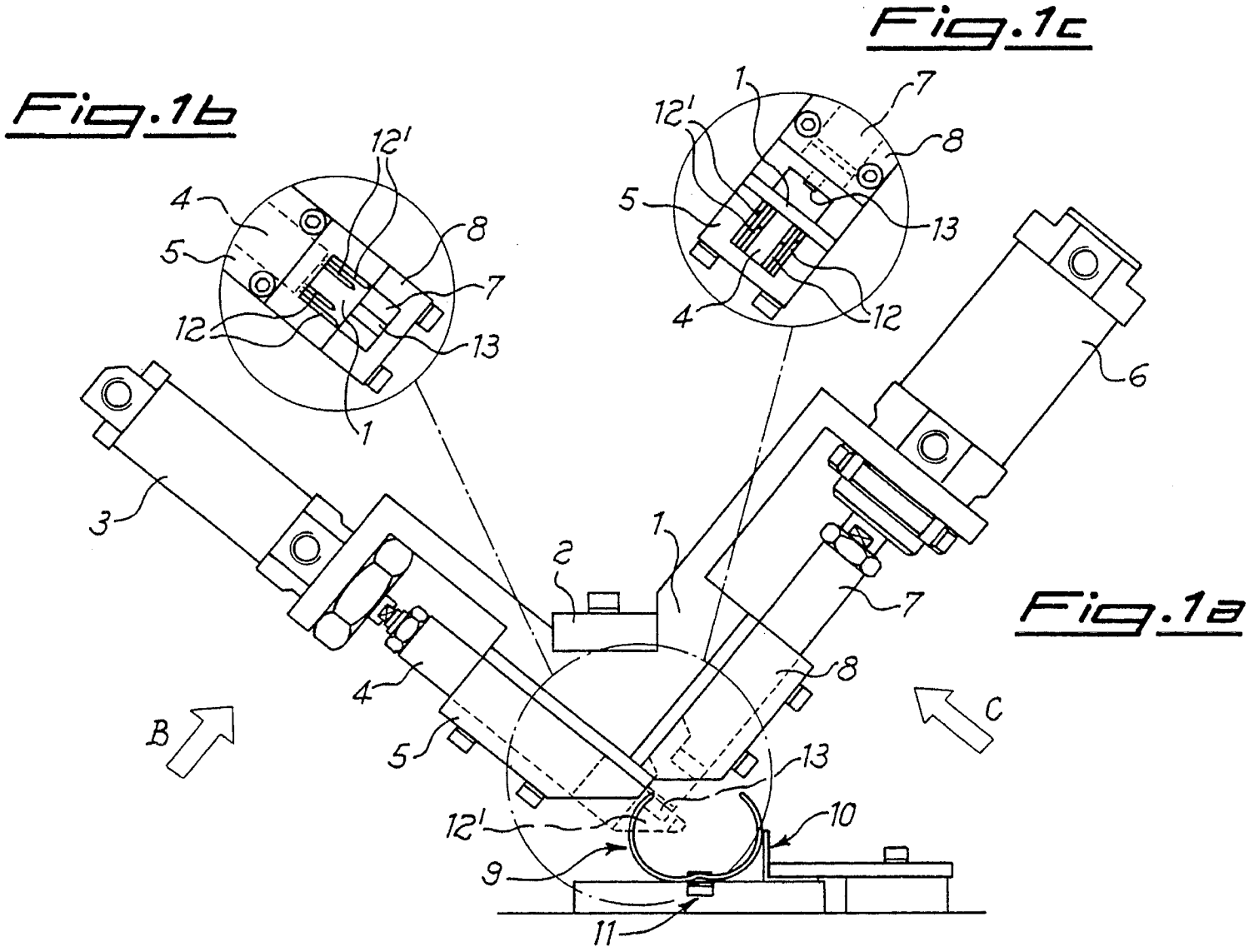

The characteristics of the device according to the present invention will be apparent from the following detailed description of a preferred embodiment thereof, reported as a non-limiting example, referring to the annexed drawings wherein:

FIG. 1*a* is a front view of the device according to the present invention;

FIGS. 1*b* and 1*c* are partial enlargements of the device of FIG. 1*a* seen along the direction of arrow B and C, respectively; and FIGS. 2, 3, 4 and 5 schematically illustrate the device operation.

Referring to FIG. 1*a*, there is seen that the device according to the present invention includes a main frame 1, substantially L-shaped, which is secured on a supporting bar 2 of the binding machine. Along a first side of frame 1 there is mounted a double-acting pneumatic jack 3 which drives a contrasting member 4 guided in its motion along the axis of said jack 3 by a guiding structure 5 also mounted on the first side of frame 1. Similarly, along the second side of frame 1 there is a jack 6, similar to jack 3 and orthogonal thereto, which drives a pushing member 7 guided along the axis of jack 6 by a guiding structure 8.

A spiral 9 is placed below the present device with its longitudinal axis orthogonal to that of jacks 3 and 6, and it is kept in that position by a lateral restraining angle iron 10 and by a conveyor belt 11 which also provides to the spiral removal at the end of the bending operation and takes it to the final binding station.

Referring also to the enlargements illustrated in FIGS. 1*b* and 1*c*, there is seen that contrast 4 essentially consists in a square-sectioned bar provided at the rear end with a member for the mounting on the piston of jack 3, and at the front with two pairs 12, 12' of flat lugs. Said lugs are mutually parallel, orthogonal to the axis of spiral 9, and shaped as a right-angled trapezium with the terminal shorter base ending as a point.

Figure 3:
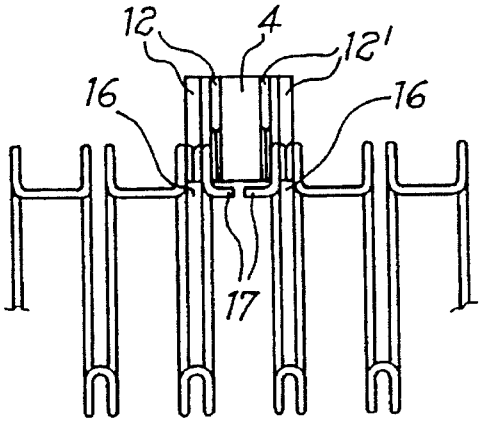

As better shown in FIG. 3, each of the two pairs 12, 12' is made up of an outer lug which extends from the side of the body of contrast 4 being just narrower than the internal width of prongs 14, and it is slightly longer than the inner lug which is spaced therefrom by a distance just greater than the diameter of the wire forming spiral 9, both lugs having the longer base as high as the body of contrast 4.

Figure 4:
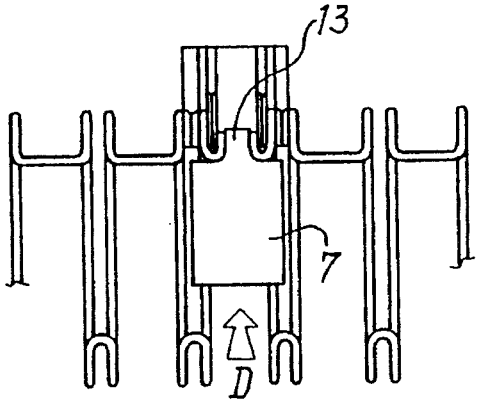

The pusher 7 interacting with contrast 4 is substantially made up of a square-sectioned bar same as that of contrast 4, but ending at the front with a reduction of the section to a rectangular shape having the longer side parallel to the axis of spiral 9. Also said bar has a rear member for the mounting on the piston of jack 6, and it is provided at the front with a full-height central tooth 13 parallel to the shorter side of the section and radiused to the body of pusher 7. As seen in FIG. 4, said tooth 13 has a width just smaller than the distance between the inner lugs of pairs 12, 12' minus twice the diameter of the wire forming spiral 9.

Referring finally to FIGS. 2, 3, 4 and 5, there is shown the operation of the device according to the present invention seen along the direction of arrow C, spiral 9 having been widened for the clarity of the drawing so that the tips of prongs 14 do not cover the device members.

Figure 2:
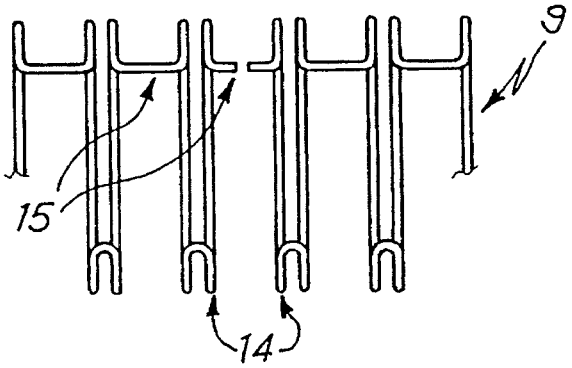

In FIG. 2, there is seen spiral 9 which has been cut at one of the lengths 15, parallel to its longitudinal axis, which connect two subsequent prongs 14. In FIG. 3, contrast 4 has advanced, along an axis orthogonal to the drawing plane, so that the outer lugs of pairs 12, 12' enter the roots 16 of the two prongs 14 between which the cut has been performed, while the lengths of spiral 9 directly adjoining the ends 17 resulting from the cut slip between the two lugs forming each of the pairs 12, 12'. In this way, the portions of spiral 9 next to ends 17 are securely retained.

Figure 5:
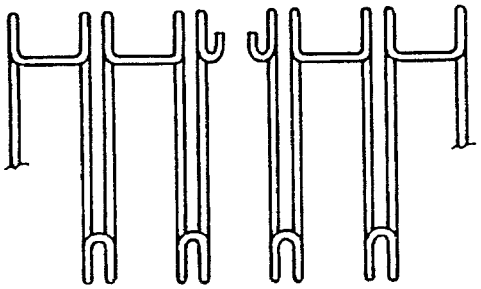

In FIG. 4, there is seen that pusher 7 moves forward in the direction of arrow D so as to bend ends 17 in the space between the inner lugs of pairs 12, 12' which act as contrasting members for the action of tooth 13. This same operating step is also illustrated in FIG. 1*a* with dotted lines representing members 12, 12' and 13 which interact at the side of spiral 9 where the cut is performed. It should be noted that the radius between tooth 13 and the body of pusher 7 allows the bending of ends 17 with a certain radius of curvature, thus avoiding the risk of break of said ends 17 which would therefore have again metallic points projecting axially. In FIG. 5, there is finally illustrated the result of the bending operation of ends 17 which become parallel to prongs 14 thus being no more a danger; therefore the object of the device according to the present invention is fully achieved.

It should be noted that one of the bent ends 17 is on the continuous spiral wound on the reel, so that each length of spiral cut to size for the binding will have the forward end (in the direction of the unwinding from the reel) already bent, whereas the rear one will be bent after the cut together with the spiral end remaining on the reel.

The above-described and illustrated embodiment of the present device is clearly just an example, several modifications suitable to adapt the various members to different operation requirements being possible. For example, the shape of the members forming contrast 4 and pusher 7 may be somewhat changed as long as said members properly carry out said contrasting and pushing functions, while various mechanical equivalents are easily provided for jacks 3 and 6 as well as for guides 5 and 8 and for the other structural elements.

I claim:

1. A device for bending ends (17) which result from cutting to size a length of metallic binding spiral (9), the metallic binding spiral (9) having a longitudinal axis and including prongs (14) having roots (16) with adjacent prongs (14) being separated by lengths (15), characterized in that the device includes a contrast (4) suitable to securely retain the roots (16) of two adjacent prongs (14) of the spiral (9) between which a cut has been performed to form the ends (17), and a pusher (7) adapted for movement orthogonally to the longitudinal axis of the spiral (9) to simultaneously bend the ends (17) parallel to the prongs (14) by interacting with said contrast (4).

2. A device according to claim 1, wherein the contrast (4) includes a front and the pusher (7) includes a body having a front, the contrast (4) is provided at the front with two pairs (12, 12') of flat lugs, mutually parallel and orthogonal to the longitudinal axis of the spiral (9), and the pusher (7) is provided at the front with a central tooth (13) radiused to the body of the pusher (7) and orthogonal to the longitudinal axis of the spiral (9).

3. A device according to claim 2, characterized in that the contract (4) and the pusher (7) move along substantially orthogonal axes.

4. A device according to claim 2, characterized in that a double-acting pneumatic jack (3) drives the contrast (4) and a similar jack (6) drives the pusher (7).

5. A device according to claim 1, characterized in that the contrast (4) and the pusher (7) move along substantially orthogonal axes.

6. A device according to claim 5, characterized in that a double-acting pneumatic jack (3) drives the contrast (4) and a similar jack (6) drives the pusher (7).

7. A device according to claim 1, characterized in that a double-acting pneumatic jack (3) drives the contrast (4) and a similar jack (6) drives the pusher (7).

* * * * *